US007387490B2

(12) United States Patent
Noera

(10) Patent No.: US 7,387,490 B2
(45) **Date of Patent: *Jun. 17, 2008**

(54) HIGH EFFICIENCY STATOR FOR THE FIRST PHASE OF A GAS TURBINE

(75) Inventor: Federico Noera, Genoa (IT)

(73) Assignee: Nuovo Pignone S.p.A., Florence (IT)

( * ) Notice: Subject to any disclaimer, the term of this patent is extended or adjusted under 35 U.S.C. 154(b) by 354 days.

This patent is subject to a terminal disclaimer.

(21) Appl. No.: 11/100,615

(22) Filed: Apr. 7, 2005

(65) Prior Publication Data

US 2005/0241287 A1 Nov. 3, 2005

(30) Foreign Application Priority Data

Apr. 9, 2004 (IT) ..... MI2004A0709

(51) Int. Cl.
*F01D 9/04* (2006.01)

(52) U.S. Cl. ..... 415/191; 416/DIG. 2; 416/223 A

(58) Field of Classification Search ..... None
See application file for complete search history.

(56) References Cited

U.S. PATENT DOCUMENTS 5,299,909 A * 4/1994 Wulf ..... 415/191

* cited by examiner

*Primary Examiner*—Richard Edgar
(74) *Attorney, Agent, or Firm*—Nixon & Vanderhye, PC

(57) ABSTRACT

A stator for the first phase of a low-pressure turbine has a series of blades each defined by coordinates of a discreet combination of points, in a Cartesian reference system (X, Y, Z) wherein the axis (Z) is a radial axis intersecting the central axis of the turbine. The profile of each blade is identified by means of a series of closed intersection curves between the profile itself and planes (X, Y) lying at distances (Z) from the central axis. Each blade has an average throat angle defined by the cosine arc of the ratio between the average throat length at mid-height of the blade and the circumferential pitch evaluated at the radius of the average throat point; the average throat angle ranges from 57° to 60°.

6 Claims, 6 Drawing Sheets

HIGH EFFICIENCY STATOR FOR THE FIRST PHASE OF A GAS TURBINE

The present invention relates to a stator for the first phase of a gas turbine.

More specifically, the invention relates to a high aerodynamic efficiency stator for the first phase of a low-pressure gas turbine.

Gas turbine refers to a rotating thermal machine which converts the enthalpy of a gas into useful work, using gases coming from a combustion and which supplies mechanical power on a rotating shaft.

The turbine therefore normally comprises a compressor or turbo-compressor, inside which the air taken from the outside is brought under pressure.

Various injectors feed the fuel which is mixed with the air to form a air-fuel ignition mixture.

The axial compressor is entrained by a turbine, or more precisely turbo-expander, which supplies mechanical energy to a user transforming the enthalpy of the gases combusted in the combustion chamber.

In applications for the generation of mechanical energy, the expansion jump is subdivided into two partial jumps, each of which takes place inside a turbine. The high-pressure turbine, downstream of the combustion chamber, entrains the compression. The low-pressure turbine, which collects the gases coming from the high-pressure turbine, is then connected to a user.

The turbo-expander, turbo-compressor, combustion chamber (or heater), outlet shaft, regulation system and ignition system, form the essential parts of a gas turbine plant.

As far as the functioning of a gas turbine is concerned, it is known that the fluid penetrates the compressor through a series of inlet ducts.

In these canalizations, the gas has low-pressure and low-temperature characteristics, whereas, as it passes through the compressor, the gas is compressed and its temperature increases.

It then penetrates into the combustion (or heating) chamber, where it undergoes a further significant increase in temperature.

The heat necessary for the temperature increase of the gas is supplied by the combustion of liquid fuel introduced into the heating chamber, by means of injectors.

The triggering of the combustion, when the machine is activated, is obtained by means of sparking plugs.

At the outlet of the combustion chamber, the high-pressure and high-temperature gas reaches the turbine, through specific ducts, where it gives up part of the energy accumulated in the compressor and heating chamber (combustor) and then flows outside by means of the discharge channels.

As the work conferred by the gas to the turbine is greater than that absorbed thereby in the compressor, a certain quantity of energy remains available, on the shaft of the machine, which purified of the work absorbed by the accessories and passive resistances of the moving mechanical organs, represents the useful work of the plant.

As a result of the high specific energy made available, the actual turbines, i.e. the turbo-expanders, are generally multiphase to optimize the yield of the energy transformation transferred by the gas into useful work.

The phase is therefore the constitutive element for each section of a turbine and comprises a stator and a rotor, each equipped with a series of blades.

One of the main requisites common to all turbines, however, is linked to the high efficiency which must be obtained by operating on all the components of the turbine.

In recent years, technologically avant-garde turbines have been further improved, by raising the thermodynamic cycle parameters such as combustion temperature, pressure changes, efficacy of the cooling system and components of the turbine.

Nowadays, for a further improvement in efficiency, it is necessary to operate on the aerodynamic conditions.

The geometrical configuration of the blade system significantly influences the aerodynamic efficiency. This depends on the fact that the geometrical characteristics of the blade determine the distribution of the relative fluid rates, consequently influencing the distribution of the limit layers along the walls and, last but not least, friction losses.

In a low-pressure turbine, it is observed that the rotation rate operating conditions can vary from 50% to 105% of the nominal rate and consequently, the blade system of the turbines must maintain a high aerodynamic efficiency within a very wide range.

Particularly in the case of stator blades of a first phase of a low-pressure turbine, an extremely high efficiency is required, at the same time maintaining a appropriate aerodynamic and mechanical load.

The overall power of the gas turbine is related not only to the efficiency of the turbine itself, but also to the gas flow-rate which it can dispose of.

A power increase can therefore be obtained by increasing the gas flow-rate which is it capable of processing.

One of the disadvantages is that this obviously causes efficiency drops which greatly reduce the power increase.

One of the objectives of the present invention is therefore to provide a stator for the first phase of a low-pressure turbine which, being the same the dimensions of the turbine, increases the power of the turbine itself.

Another objective of the present invention is to provide a stator for the first phase of a low-pressure turbine which allows a high aerodynamic efficiency and at the same time enables a high flow-rate of the turbine to be obtained, with a consequent increase in the power of the turbine itself with the same turbine dimensions.

A further objective of the present invention is to provide a stator for the first phase of a low-pressure turbine which allows a high aerodynamic efficiency.

Yet another objective of the present invention is to provide a stator for the first phase of a low-pressure turbine which can be produced on a wide scale by means of automated processes.

A further objective of the present invention is to provide a stator for the first phase of a low-pressure turbine which, through three-dimensional modeling, can be defined by means of a limited series of starting elements.

These and other objectives of the present invention are obtained by means of a stator for the first phase of a low-pressure turbine according to what is specified in claim 1.

Further characteristics of the stator according to the invention are the object of the subsequent claims.

The characteristics and advantages of the stator for the first phase of a low-pressure turbine according to the present invention will appear more evident from the following illustrative and non-limiting description, referring to the enclosed drawings, in which.

Figure 1:
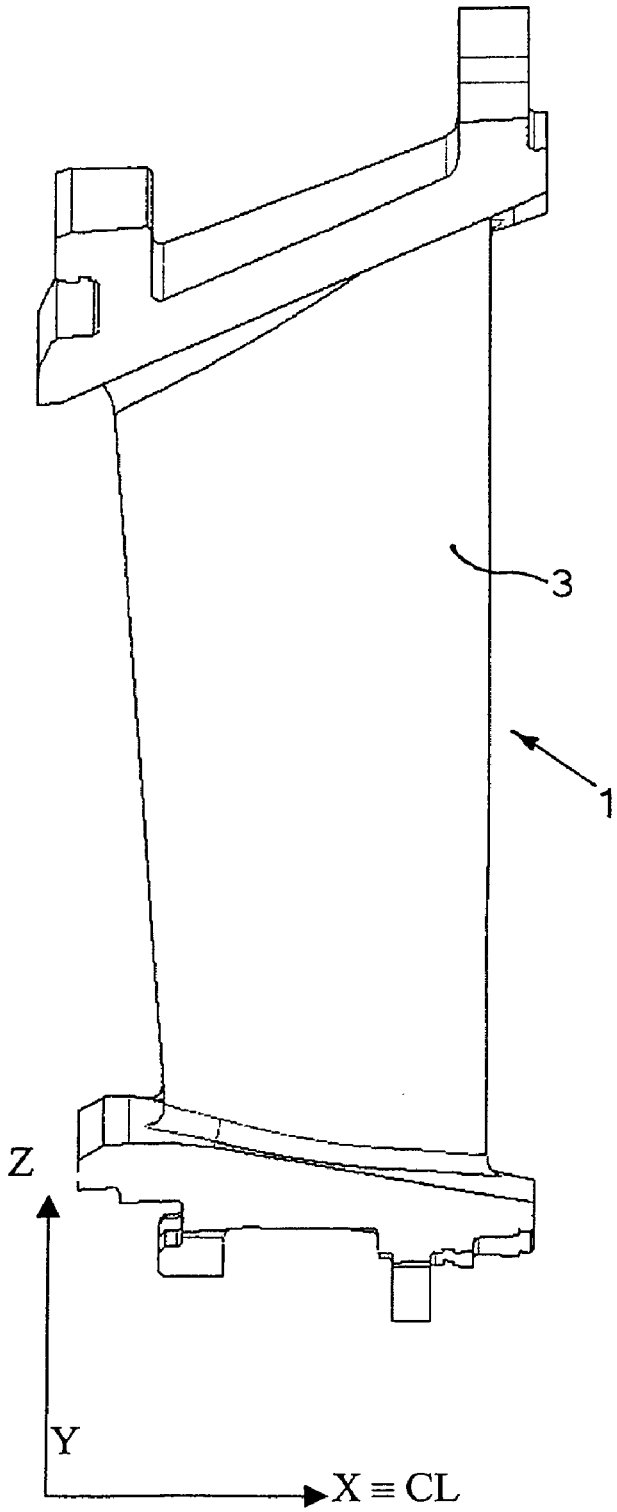
FIG. 1 is a raised view of a blade of the stator of a turbine produced with the aerodynamic profile according to the invention.
Figure 2:
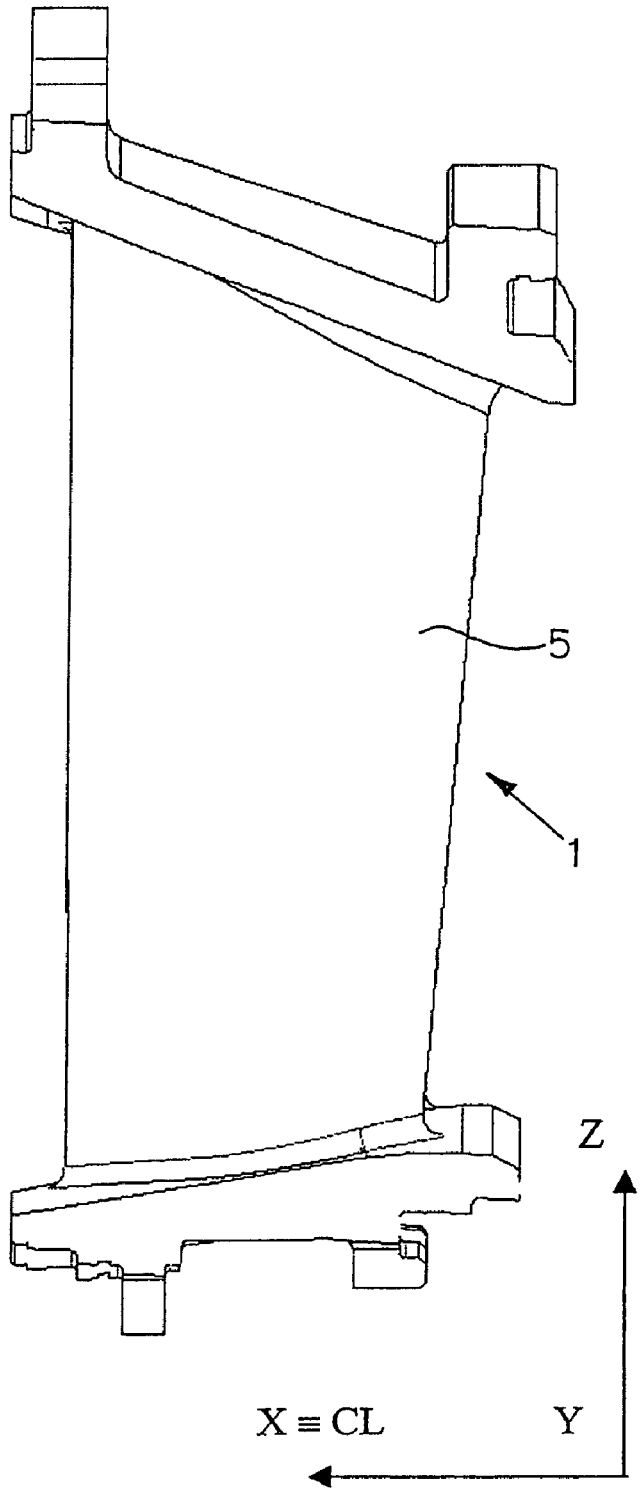
FIG. 2 is a raised view of the opposite side of the blade of FIG. 1.
Figure 3:
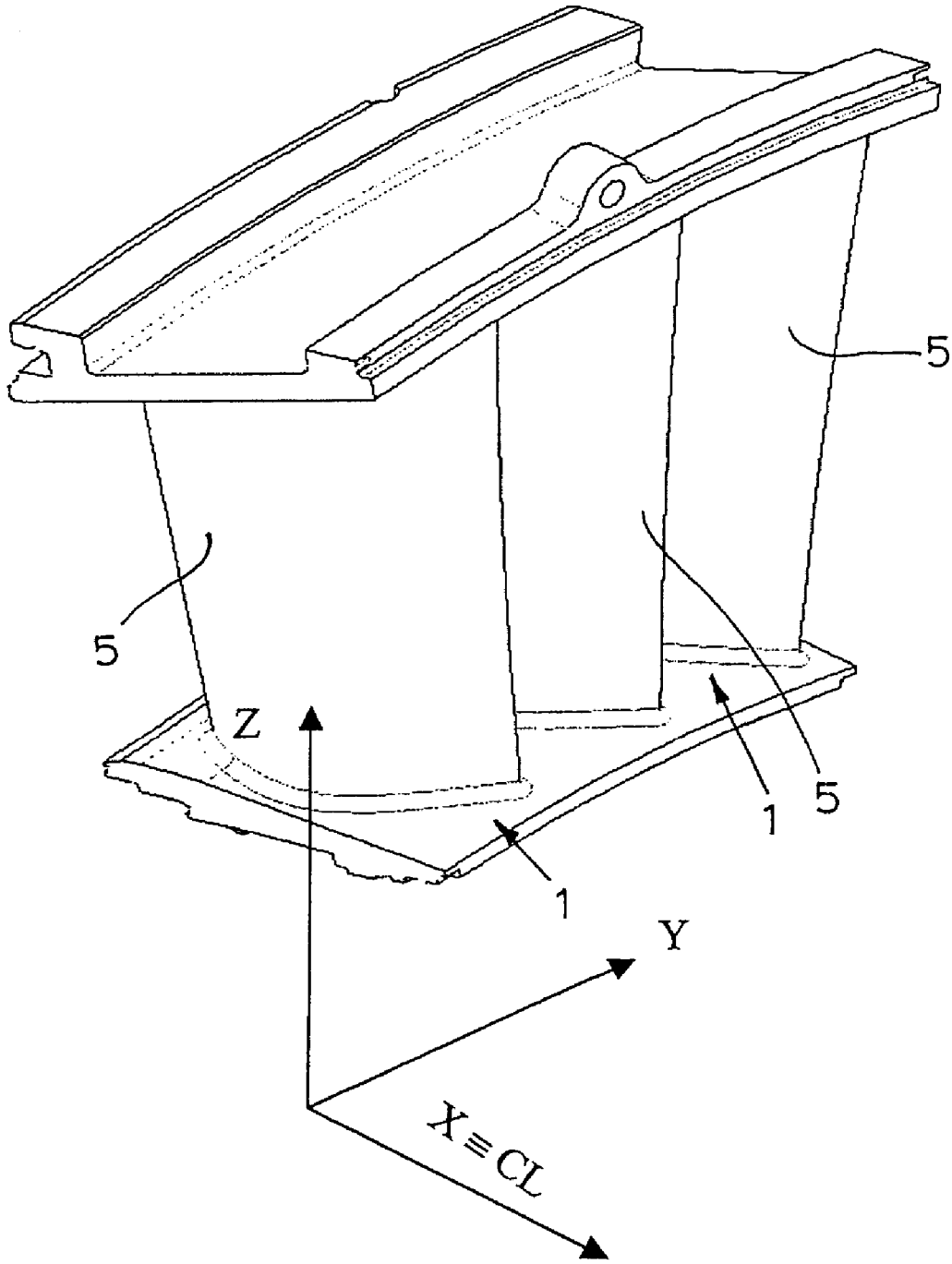
FIGS. 3 and 4 are raised schematic views of a plurality of blades from the discharging side according to the invention.
Figure 4:
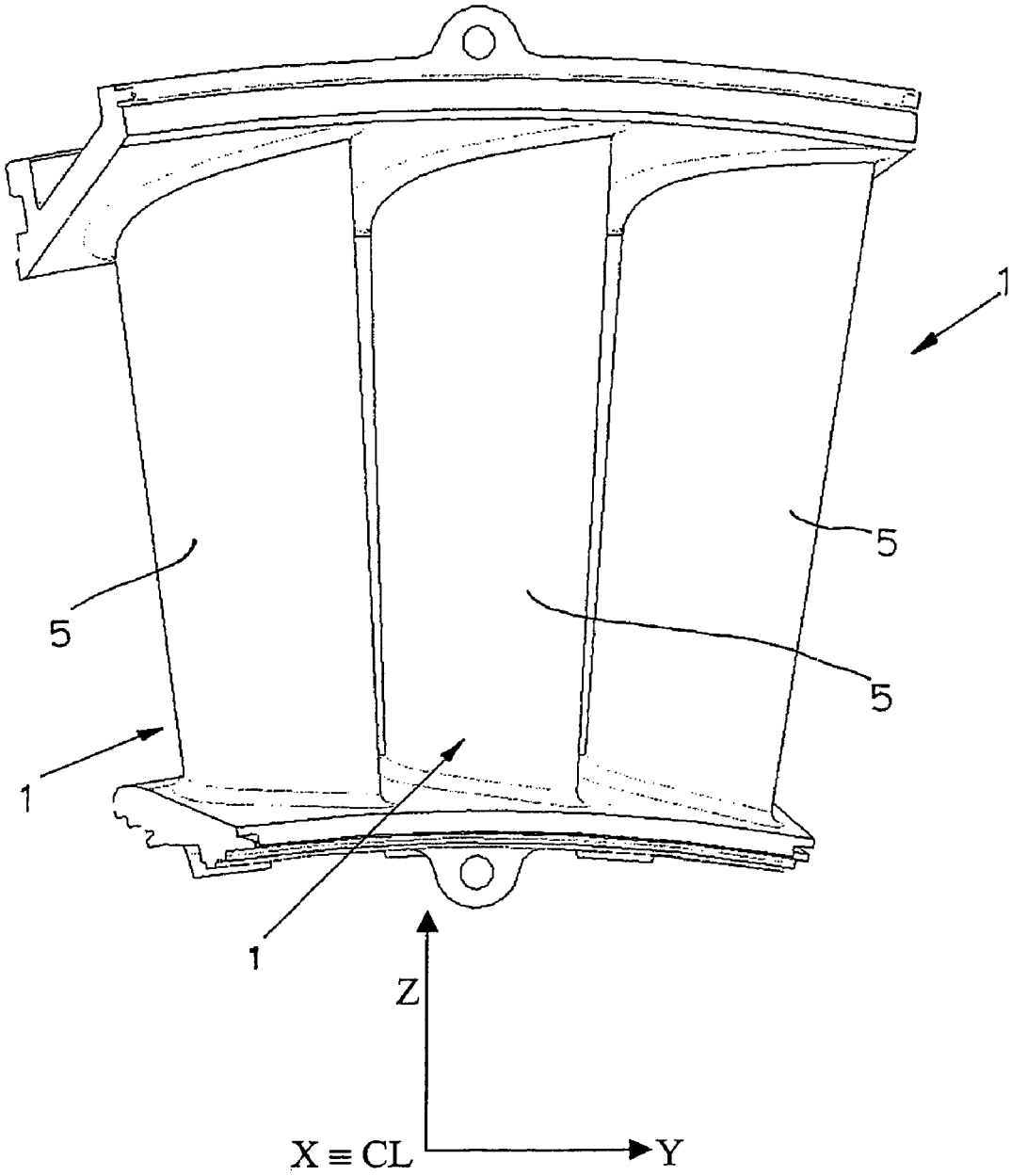
Figure 5:
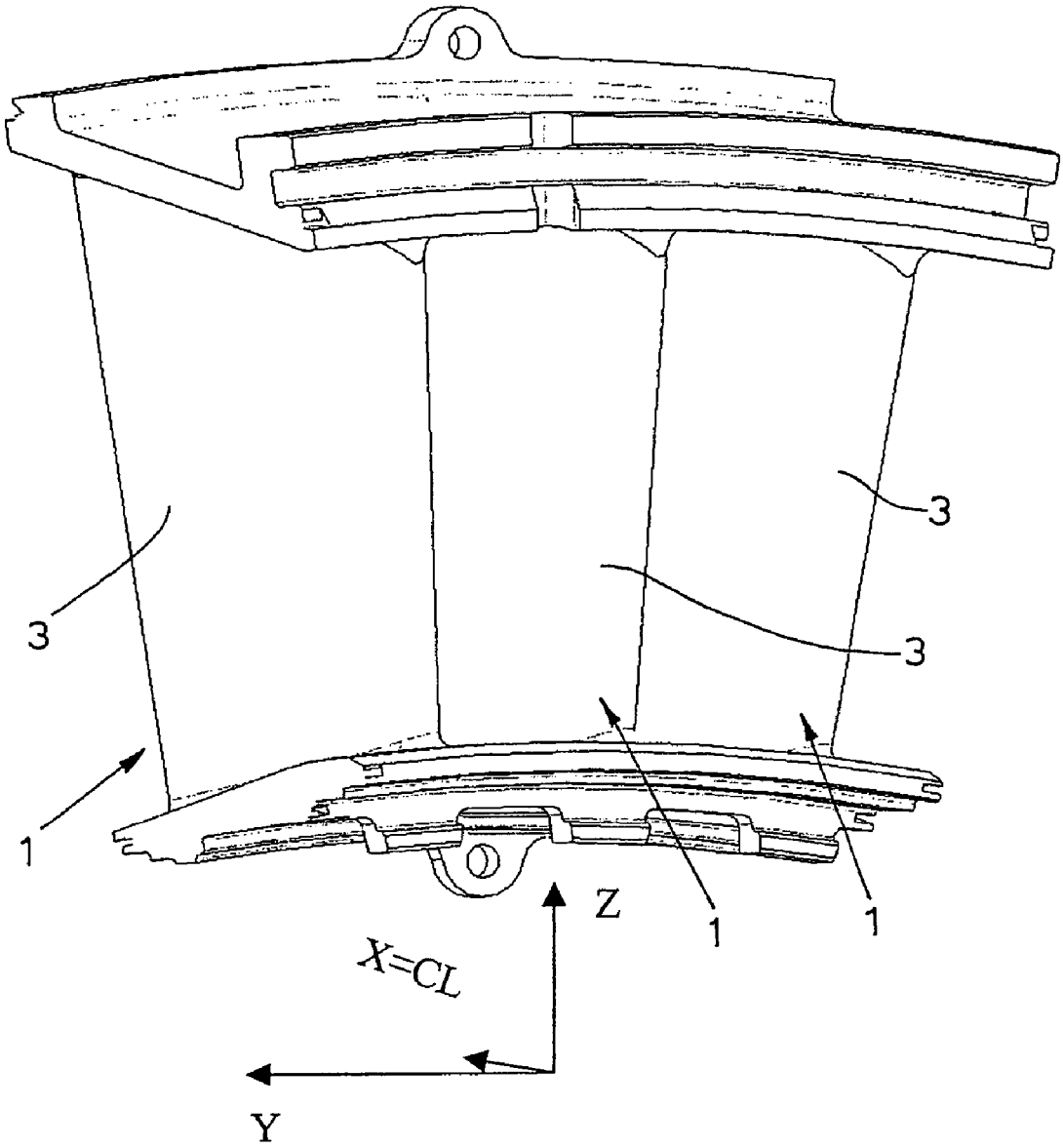
FIG. 5 is a raised view in the inlet direction of the gas flow from the side under pressure.
Figure 6:
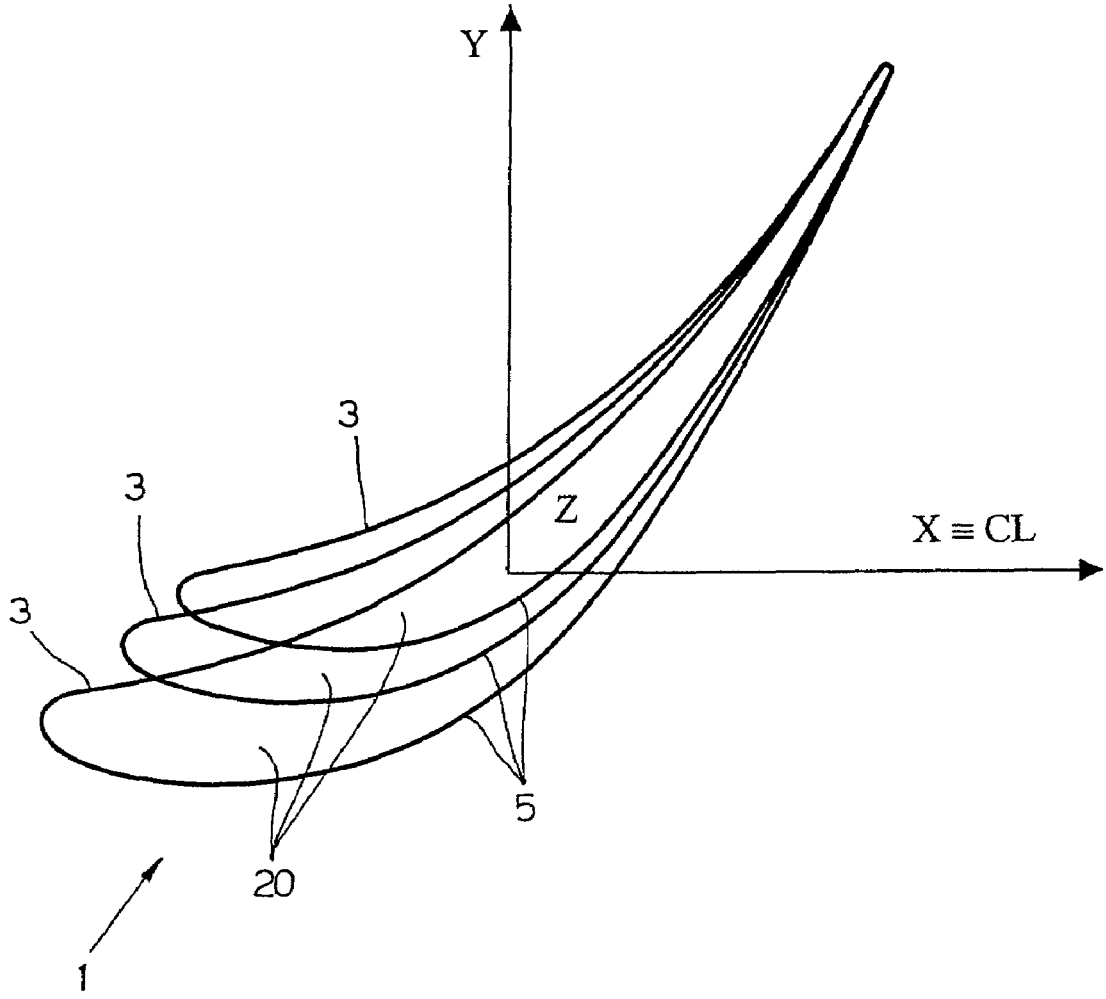
FIG. 6 is a schematic view from above of the traces of the aerodynamic profile according to the invention, at different levels of the blade.

With reference to the figures, a stator is provided for a first phase of a gas turbine comprising an outer side surface and a series of blades 1 distributed on the outer side surface of the stator itself.

Said blades 1 are uniformly distributed on said outer side surface.

Each blade 1 is defined by means of coordinates of a discreet combination of points, in a Cartesian reference system X,Y,Z, wherein the axis Z is a radial axis intersecting the central axis of the turbine.

The profile of each blade 1 is identified by means of a series of closed intersection curves 20 between the profile itself and planes X,Y lying at distances Z from the central axis.

The profile of each blade 1 comprises a first concave surface 3, which is under pressure, and a second convex surface 5 which is in depression and which is opposite to the first.

The two surfaces 3, 5 are continuous and jointly form the profile of each blade 1.

At the ends, according to the known art, there is a connector between each blade 1 and the stator itself.

Each closed curve 20 has a throat angle defined by the cosine arc of the ratio between the length of the throat and the circumferential pitch, evaluated at the radius corresponding to the distance Z from the central axis of the closed curve 20 itself.

Each blade 1 defines with the adjacent blades, passage sections for a gas, respectively a first inlet section and a throat section through which a gas passes in sequence.

It was observed that by increasing the throat section, a greater quantity of gas can flow through the turbine within the time unit.

It was therefore possible to increase the flow-rate of the gas turbine with the same number of blades and maintaining the same dimensional characteristics.

The increase in each throat section of the stator was obtained by suitably varying the throat angle of each closed curve 20.

Each blade 1 has an average throat angle evaluated at mid-height of the blade 1 itself.

Said average throat angle preferably ranges from 57° to 60°.

Said average throat angle is preferably 58.5°.

Each blade 1 has a throat angle distribution which varies along the height of the blade 1 itself.

With respect to the average throat angle value, said throat angle distribution has a shift preferably ranging from +1° to −1°, so as to reduce the secondary pressure drops to the minimum.

In this way, it is possible to obtain a satisfactory efficiency and useful life by appropriately shaping the profile of the stator blades of the first phase of the turbine.

There is in fact a relation between the outlet section and characteristics such as efficiency and useful life of the turbine blades obtained by shaping the blades in relation to the inclination of the outlet section itself.

The profile of each blade 1 was suitably shaped to allow the efficiency to be maintained at high levels.

This is extremely important as normally, when the flow-rate is increased, a consequent drop in efficiency occurs due to the increase in aerodynamic drops, and this greatly limits the overall increase in the power of the turbine itself, as the power is proportionally influenced by these two factors, i.e. the flow-rate and conversion efficiency.

In addition, the useful life of each blade 1 is also directly influenced by said average throat angle.

This is because, according to the average throat angle, the aerodynamic load varies on each blade and causes mechanical stress thereon which, together with the thermal stress, developed during the functioning of the turbine itself, causes, with time, a loss in the functionality of each blade resulting in its substitution.

According to the present invention, once the average throat angle has been fixed as also the shift of the throat angle distribution along the height Z of the blade 1, it is possible to shape the profile of each blade 1 so as to maintain a high efficiency and an adequate useful life.

A stator of a first phase of a gas turbine preferably comprises a series of shaped blades 1, each of which has a shaped aerodynamic profile.

The aerodynamic profile of each blade 1 of the stator for the first low-pressure phase of a gas turbine is defined by means of a series of closed curves 20 whose coordinates are defined with respect to a Cartesian reference system X,Y,Z, wherein the axis Z is a radial axis intersecting the central axis of the turbine, and said closed curves 20 lying at distances Z from the central axis, are defined according to Table I, whose values refer to a room temperature profile and are divided by value, expressed in millimeters, of the axial chord referring to the most internal distance Z of the blade 1, indicated in table 1 with CHX.

TABLE I

| X/CHX | Y/CHX | Z/CHX |
|---|---|---|
| −0.9944 | −0.5489 | 5.9435 |
| −0.9942 | −0.5453 | 5.9435 |
| −0.9938 | −0.5418 | 5.9435 |
| −0.9931 | −0.5374 | 5.9435 |
| −0.9921 | −0.5331 | 5.9435 |
| −0.9907 | −0.5283 | 5.9435 |
| −0.9889 | −0.5237 | 5.9435 |
| −0.9873 | −0.5204 | 5.9435 |
| −0.9857 | −0.5172 | 5.9435 |
| −0.9841 | −0.5145 | 5.9435 |
| −0.9824 | −0.5119 | 5.9435 |
| −0.9799 | −0.5083 | 5.9435 |
| −0.9773 | −0.5049 | 5.9435 |
| −0.9745 | −0.5018 | 5.9435 |
| −0.9716 | −0.4988 | 5.9435 |
| −0.9685 | −0.4959 | 5.9435 |
| −0.9653 | −0.4931 | 5.9435 |
| −0.9596 | −0.4888 | 5.9435 |
| −0.9537 | −0.4850 | 5.9435 |
| −0.9474 | −0.4815 | 5.9435 |
| −0.9409 | −0.4784 | 5.9435 |
| −0.9343 | −0.4758 | 5.9435 |
| −0.9276 | −0.4735 | 5.9435 |
| −0.9208 | −0.4712 | 5.9435 |
| −0.9141 | −0.4689 | 5.9435 |
| −0.9060 | −0.4663 | 5.9435 |
| −0.8978 | −0.4637 | 5.9435 |
| −0.8890 | −0.4611 | 5.9435 |
| −0.8801 | −0.4585 | 5.9435 |
| −0.8664 | −0.4548 | 5.9435 |
| −0.8527 | −0.4513 | 5.9435 |
| −0.8355 | −0.4472 | 5.9435 |
| −0.8183 | −0.4433 | 5.9435 |

TABLE I-continued

| X/CHX | Y/CHX | Z/CHX |
|---|---|---|
| −0.7942 | −0.4384 | 5.9435 |
| −0.7701 | −0.4339 | 5.9435 |
| −0.7461 | −0.4298 | 5.9435 |
| −0.7221 | −0.4259 | 5.9435 |
| −0.6983 | −0.4222 | 5.9435 |
| −0.6746 | −0.4185 | 5.9435 |
| −0.6511 | −0.4149 | 5.9435 |
| −0.6276 | −0.4112 | 5.9435 |
| −0.6045 | −0.4074 | 5.9435 |
| −0.5815 | −0.4033 | 5.9435 |
| −0.5589 | −0.3990 | 5.9435 |
| −0.5364 | −0.3943 | 5.9435 |
| −0.5143 | −0.3892 | 5.9435 |
| −0.4924 | −0.3837 | 5.9435 |
| −0.4711 | −0.3778 | 5.9435 |
| −0.4500 | −0.3713 | 5.9435 |
| −0.4093 | −0.3570 | 5.9435 |
| −0.3705 | −0.3407 | 5.9435 |
| −0.3338 | −0.3226 | 5.9435 |
| −0.2992 | −0.3028 | 5.9435 |
| −0.2666 | −0.2817 | 5.9435 |
| −0.2360 | −0.2594 | 5.9435 |
| −0.2072 | −0.2360 | 5.9435 |
| −0.1801 | −0.2119 | 5.9435 |
| −0.1545 | −0.1870 | 5.9435 |
| −0.1304 | −0.1616 | 5.9435 |
| −0.1074 | −0.1358 | 5.9435 |
| −0.0857 | −0.1095 | 5.9435 |
| −0.0649 | −0.0829 | 5.9435 |
| −0.0478 | −0.0598 | 5.9435 |
| −0.0367 | −0.0442 | 5.9435 |
| −0.0312 | −0.0364 | 5.9435 |
| −0.0258 | −0.0286 | 5.9435 |
| −0.0205 | −0.0207 | 5.9435 |
| −0.0152 | −0.0128 | 5.9435 |
| −0.0126 | −0.0089 | 5.9435 |
| −0.0100 | −0.0049 | 5.9435 |
| −0.0074 | −0.0009 | 5.9435 |
| −0.0048 | 0.0031 | 5.9435 |
| −0.0035 | 0.0045 | 5.9435 |
| −0.0015 | 0.0055 | 5.9435 |
| 0.0008 | 0.0057 | 5.9435 |
| 0.0029 | 0.0049 | 5.9435 |
| 0.0045 | 0.0034 | 5.9435 |
| 0.0055 | 0.0014 | 5.9435 |
| 0.0056 | −0.0008 | 5.9435 |
| 0.0051 | −0.0025 | 5.9435 |
| 0.0028 | −0.0072 | 5.9435 |
| 0.0006 | −0.0118 | 5.9435 |
| −0.0017 | −0.0163 | 5.9435 |
| −0.0039 | −0.0208 | 5.9435 |
| −0.0084 | −0.0299 | 5.9435 |
| −0.0129 | −0.0388 | 5.9435 |
| −0.0174 | −0.0478 | 5.9435 |
| −0.0220 | −0.0567 | 5.9435 |
| −0.0311 | −0.0745 | 5.9435 |
| −0.0450 | −0.1009 | 5.9435 |
| −0.0617 | −0.1317 | 5.9435 |
| −0.0789 | −0.1625 | 5.9435 |
| −0.0967 | −0.1934 | 5.9435 |
| −0.1152 | −0.2245 | 5.9435 |
| −0.1346 | −0.2560 | 5.9435 |
| −0.1551 | −0.2879 | 5.9435 |
| −0.1768 | −0.3204 | 5.9435 |
| −0.1999 | −0.3535 | 5.9435 |
| −0.2247 | −0.3875 | 5.9435 |
| −0.2515 | −0.4224 | 5.9435 |
| −0.2808 | −0.4585 | 5.9435 |
| −0.3130 | −0.4952 | 5.9435 |
| −0.3490 | −0.5312 | 5.9435 |
| −0.3686 | −0.5488 | 5.9435 |
| −0.3889 | −0.5655 | 5.9435 |
| −0.4106 | −0.5818 | 5.9435 |
| −0.4331 | −0.5971 | 5.9435 |
| −0.4569 | −0.6117 | 5.9435 |
| −0.4814 | −0.6251 | 5.9435 |
| −0.5073 | −0.6374 | 5.9435 |

TABLE I-continued

| X/CHX | Y/CHX | Z/CHX |
|---|---|---|
| −0.5337 | −0.6483 | 5.9435 |
| −0.5613 | −0.6578 | 5.9435 |
| −0.5895 | −0.6658 | 5.9435 |
| −0.6186 | −0.6723 | 5.9435 |
| −0.6480 | −0.6770 | 5.9435 |
| −0.6781 | −0.6800 | 5.9435 |
| −0.7083 | −0.6812 | 5.9435 |
| −0.7390 | −0.6805 | 5.9435 |
| −0.7695 | −0.6779 | 5.9435 |
| −0.7914 | −0.6748 | 5.9435 |
| −0.8131 | −0.6708 | 5.9435 |
| −0.8305 | −0.6667 | 5.9435 |
| −0.8476 | −0.6621 | 5.9435 |
| −0.8587 | −0.6587 | 5.9435 |
| −0.8697 | −0.6550 | 5.9435 |
| −0.8798 | −0.6513 | 5.9435 |
| −0.8899 | −0.6475 | 5.9435 |
| −0.8981 | −0.6440 | 5.9435 |
| −0.9064 | −0.6405 | 5.9435 |
| −0.9145 | −0.6367 | 5.9435 |
| −0.9226 | −0.6328 | 5.9435 |
| −0.9306 | −0.6288 | 5.9435 |
| −0.9386 | −0.6246 | 5.9435 |
| −0.9465 | −0.6203 | 5.9435 |
| −0.9542 | −0.6157 | 5.9435 |
| −0.9587 | −0.6127 | 5.9435 |
| −0.9630 | −0.6096 | 5.9435 |
| −0.9671 | −0.6061 | 5.9435 |
| −0.9711 | −0.6024 | 5.9435 |
| −0.9748 | −0.5985 | 5.9435 |
| −0.9783 | −0.5944 | 5.9435 |
| −0.9815 | −0.5902 | 5.9435 |
| −0.9843 | −0.5857 | 5.9435 |
| −0.9868 | −0.5813 | 5.9435 |
| −0.9889 | −0.5767 | 5.9435 |
| −0.9908 | −0.5715 | 5.9435 |
| −0.9924 | −0.5663 | 5.9435 |
| −0.9934 | −0.5615 | 5.9435 |
| −0.9940 | −0.5567 | 5.9435 |
| −0.9943 | −0.5528 | 5.9435 |
| −0.9944 | −0.5489 | 5.9435 |
| −0.9940 | −0.5489 | 6.2065 |
| −0.9938 | −0.5454 | 6.2065 |
| −0.9935 | −0.5419 | 6.2065 |
| −0.9928 | −0.5376 | 6.2065 |
| −0.9918 | −0.5334 | 6.2065 |
| −0.9904 | −0.5287 | 6.2065 |
| −0.9886 | −0.5241 | 6.2065 |
| −0.9872 | −0.5208 | 6.2065 |
| −0.9855 | −0.5177 | 6.2065 |
| −0.9841 | −0.5152 | 6.2065 |
| −0.9826 | −0.5127 | 6.2065 |
| −0.9803 | −0.5093 | 6.2065 |
| −0.9778 | −0.5061 | 6.2065 |
| −0.9752 | −0.5030 | 6.2065 |
| −0.9724 | −0.5001 | 6.2065 |
| −0.9695 | −0.4972 | 6.2065 |
| −0.9664 | −0.4945 | 6.2065 |
| −0.9610 | −0.4902 | 6.2065 |
| −0.9553 | −0.4864 | 6.2065 |
| −0.9493 | −0.4828 | 6.2065 |
| −0.9431 | −0.4797 | 6.2065 |
| −0.9368 | −0.4770 | 6.2065 |
| −0.9304 | −0.4747 | 6.2065 |
| −0.9239 | −0.4724 | 6.2065 |
| −0.9173 | −0.4701 | 6.2065 |
| −0.9095 | −0.4675 | 6.2065 |
| −0.9016 | −0.4650 | 6.2065 |
| −0.8930 | −0.4624 | 6.2065 |
| −0.8844 | −0.4599 | 6.2065 |
| −0.8712 | −0.4562 | 6.2065 |
| −0.8579 | −0.4527 | 6.2065 |
| −0.8413 | −0.4486 | 6.2065 |
| −0.8246 | −0.4448 | 6.2065 |
| −0.8013 | −0.4398 | 6.2065 |
| −0.7779 | −0.4353 | 6.2065 |
| −0.7546 | −0.4311 | 6.2065 |

TABLE I-continued

| X/CHX | Y/CHX | Z/CHX |
|---|---|---|
| −0.7312 | −0.4272 | 6.2065 |
| −0.7081 | −0.4235 | 6.2065 |
| −0.6849 | −0.4198 | 6.2065 |
| −0.6620 | −0.4163 | 6.2065 |
| −0.6391 | −0.4126 | 6.2065 |
| −0.6165 | −0.4089 | 6.2065 |
| −0.5939 | −0.4049 | 6.2065 |
| −0.5717 | −0.4008 | 6.2065 |
| −0.5496 | −0.3963 | 6.2065 |
| −0.5279 | −0.3915 | 6.2065 |
| −0.5063 | −0.3862 | 6.2065 |
| −0.4851 | −0.3806 | 6.2065 |
| −0.4642 | −0.3745 | 6.2065 |
| −0.4235 | −0.3609 | 6.2065 |
| −0.3846 | −0.3453 | 6.2065 |
| −0.3475 | −0.3280 | 6.2065 |
| −0.3122 | −0.3088 | 6.2065 |
| −0.2788 | −0.2882 | 6.2065 |
| −0.2472 | −0.2661 | 6.2065 |
| −0.2173 | −0.2428 | 6.2065 |
| −0.1891 | −0.2185 | 6.2065 |
| −0.1624 | −0.1934 | 6.2065 |
| −0.1371 | −0.1675 | 6.2065 |
| −0.1130 | −0.1409 | 6.2065 |
| −0.0901 | −0.1138 | 6.2065 |
| −0.0682 | −0.0862 | 6.2065 |
| −0.0502 | −0.0623 | 6.2065 |
| −0.0386 | −0.0461 | 6.2065 |
| −0.0329 | −0.0379 | 6.2065 |
| −0.0272 | −0.0297 | 6.2065 |
| −0.0216 | −0.0216 | 6.2065 |
| −0.0160 | −0.0133 | 6.2065 |
| −0.0133 | −0.0092 | 6.2065 |
| −0.0106 | −0.0050 | 6.2065 |
| −0.0078 | −0.0009 | 6.2065 |
| −0.0051 | 0.0033 | 6.2065 |
| −0.0037 | 0.0049 | 6.2065 |
| −0.0015 | 0.0059 | 6.2065 |
| 0.0008 | 0.0060 | 6.2065 |
| 0.0031 | 0.0052 | 6.2065 |
| 0.0049 | 0.0037 | 6.2065 |
| 0.0059 | 0.0015 | 6.2065 |
| 0.0060 | −0.0008 | 6.2065 |
| 0.0054 | −0.0027 | 6.2065 |
| 0.0030 | −0.0076 | 6.2065 |
| 0.0006 | −0.0123 | 6.2065 |
| −0.0017 | −0.0170 | 6.2065 |
| −0.0041 | −0.0216 | 6.2065 |
| −0.0089 | −0.0310 | 6.2065 |
| −0.0136 | −0.0403 | 6.2065 |
| −0.0184 | −0.0496 | 6.2065 |
| −0.0232 | −0.0588 | 6.2065 |
| −0.0329 | −0.0773 | 6.2065 |
| −0.0476 | −0.1049 | 6.2065 |
| −0.0651 | −0.1370 | 6.2065 |
| −0.0831 | −0.1691 | 6.2065 |
| −0.1017 | −0.2014 | 6.2065 |
| −0.1210 | −0.2339 | 6.2065 |
| −0.1411 | −0.2667 | 6.2065 |
| −0.1623 | −0.2998 | 6.2065 |
| −0.1846 | −0.3335 | 6.2065 |
| −0.2083 | −0.3676 | 6.2065 |
| −0.2337 | −0.4024 | 6.2065 |
| −0.2610 | −0.4377 | 6.2065 |
| −0.2908 | −0.4738 | 6.2065 |
| −0.3236 | −0.5100 | 6.2065 |
| −0.3601 | −0.5450 | 6.2065 |
| −0.3799 | −0.5619 | 6.2065 |
| −0.4005 | −0.5779 | 6.2065 |
| −0.4224 | −0.5933 | 6.2065 |
| −0.4450 | −0.6076 | 6.2065 |
| −0.4689 | −0.6211 | 6.2065 |
| −0.4935 | −0.6334 | 6.2065 |
| −0.5192 | −0.6445 | 6.2065 |
| −0.5455 | −0.6542 | 6.2065 |
| −0.5729 | −0.6626 | 6.2065 |
| −0.6006 | −0.6694 | 6.2065 |

TABLE I-continued

| X/CHX | Y/CHX | Z/CHX |
|---|---|---|
| −0.6292 | −0.6748 | 6.2065 |
| −0.6580 | −0.6785 | 6.2065 |
| −0.6875 | −0.6807 | 6.2065 |
| −0.7170 | −0.6811 | 6.2065 |
| −0.7468 | −0.6799 | 6.2065 |
| −0.7765 | −0.6768 | 6.2065 |
| −0.7978 | −0.6735 | 6.2065 |
| −0.8189 | −0.6692 | 6.2065 |
| −0.8357 | −0.6651 | 6.2065 |
| −0.8524 | −0.6604 | 6.2065 |
| −0.8632 | −0.6569 | 6.2065 |
| −0.8738 | −0.6533 | 6.2065 |
| −0.8836 | −0.6496 | 6.2065 |
| −0.8933 | −0.6458 | 6.2065 |
| −0.9014 | −0.6424 | 6.2065 |
| −0.9093 | −0.6389 | 6.2065 |
| −0.9173 | −0.6352 | 6.2065 |
| −0.9251 | −0.6314 | 6.2065 |
| −0.9329 | −0.6274 | 6.2065 |
| −0.9406 | −0.6233 | 6.2065 |
| −0.9482 | −0.6190 | 6.2065 |
| −0.9556 | −0.6144 | 6.2065 |
| −0.9600 | −0.6115 | 6.2065 |
| −0.9641 | −0.6083 | 6.2065 |
| −0.9681 | −0.6049 | 6.2065 |
| −0.9719 | −0.6012 | 6.2065 |
| −0.9754 | −0.5974 | 6.2065 |
| −0.9787 | −0.5934 | 6.2065 |
| −0.9817 | −0.5892 | 6.2065 |
| −0.9844 | −0.5848 | 6.2065 |
| −0.9867 | −0.5806 | 6.2065 |
| −0.9887 | −0.5763 | 6.2065 |
| −0.9906 | −0.5712 | 6.2065 |
| −0.9921 | −0.5660 | 6.2065 |
| −0.9930 | −0.5613 | 6.2065 |
| −0.9937 | −0.5566 | 6.2065 |
| −0.9939 | −0.5527 | 6.2065 |
| −0.9940 | −0.5489 | 6.2065 |
| −0.9936 | −0.5489 | 6.4695 |
| −0.9934 | −0.5455 | 6.4695 |
| −0.9931 | −0.5420 | 6.4695 |
| −0.9924 | −0.5378 | 6.4695 |
| −0.9915 | −0.5336 | 6.4695 |
| −0.9901 | −0.5290 | 6.4695 |
| −0.9884 | −0.5245 | 6.4695 |
| −0.9870 | −0.5213 | 6.4695 |
| −0.9854 | −0.5182 | 6.4695 |
| −0.9841 | −0.5158 | 6.4695 |
| −0.9828 | −0.5136 | 6.4695 |
| −0.9806 | −0.5104 | 6.4695 |
| −0.9783 | −0.5073 | 6.4695 |
| −0.9758 | −0.5042 | 6.4695 |
| −0.9732 | −0.5013 | 6.4695 |
| −0.9704 | −0.4985 | 6.4695 |
| −0.9675 | −0.4958 | 6.4695 |
| −0.9624 | −0.4916 | 6.4695 |
| −0.9570 | −0.4877 | 6.4695 |
| −0.9513 | −0.4842 | 6.4695 |
| −0.9454 | −0.4810 | 6.4695 |
| −0.9393 | −0.4783 | 6.4695 |
| −0.9332 | −0.4758 | 6.4695 |
| −0.9269 | −0.4735 | 6.4695 |
| −0.9206 | −0.4714 | 6.4695 |
| −0.9130 | −0.4688 | 6.4695 |
| −0.9054 | −0.4664 | 6.4695 |
| −0.8971 | −0.4638 | 6.4695 |
| −0.8888 | −0.4613 | 6.4695 |
| −0.8760 | −0.4576 | 6.4695 |
| −0.8631 | −0.4541 | 6.4695 |
| −0.8470 | −0.4501 | 6.4695 |
| −0.8309 | −0.4462 | 6.4695 |
| −0.8083 | −0.4413 | 6.4695 |
| −0.7856 | −0.4367 | 6.4695 |
| −0.7630 | −0.4325 | 6.4695 |
| −0.7403 | −0.4285 | 6.4695 |
| −0.7178 | −0.4248 | 6.4695 |
| −0.6953 | −0.4212 | 6.4695 |

TABLE I-continued

| X/CHX | Y/CHX | Z/CHX |
|---|---|---|
| −0.6729 | −0.4176 | 6.4695 |
| −0.6506 | −0.4140 | 6.4695 |
| −0.6285 | −0.4103 | 6.4695 |
| −0.6064 | −0.4065 | 6.4695 |
| −0.5846 | −0.4025 | 6.4695 |
| −0.5628 | −0.3982 | 6.4695 |
| −0.5414 | −0.3937 | 6.4695 |
| −0.5201 | −0.3887 | 6.4695 |
| −0.4991 | −0.3834 | 6.4695 |
| −0.4783 | −0.3776 | 6.4695 |
| −0.4378 | −0.3647 | 6.4695 |
| −0.3987 | −0.3500 | 6.4695 |
| −0.3611 | −0.3333 | 6.4695 |
| −0.3252 | −0.3148 | 6.4695 |
| −0.2910 | −0.2946 | 6.4695 |
| −0.2584 | −0.2728 | 6.4695 |
| −0.2275 | −0.2497 | 6.4695 |
| −0.1981 | −0.2252 | 6.4695 |
| −0.1702 | −0.1997 | 6.4695 |
| −0.1437 | −0.1733 | 6.4695 |
| −0.1185 | −0.1461 | 6.4695 |
| −0.0945 | −0.1182 | 6.4695 |
| −0.0716 | −0.0896 | 6.4695 |
| −0.0527 | −0.0647 | 6.4695 |
| −0.0405 | −0.0479 | 6.4695 |
| −0.0345 | −0.0394 | 6.4695 |
| −0.0286 | −0.0309 | 6.4695 |
| −0.0227 | −0.0224 | 6.4695 |
| −0.0169 | −0.0138 | 6.4695 |
| −0.0140 | −0.0095 | 6.4695 |
| −0.0111 | −0.0051 | 6.4695 |
| −0.0083 | −0.0008 | 6.4695 |
| −0.0054 | 0.0035 | 6.4695 |
| −0.0039 | 0.0052 | 6.4695 |
| −0.0016 | 0.0063 | 6.4695 |
| 0.0009 | 0.0064 | 6.4695 |
| 0.0033 | 0.0056 | 6.4695 |
| 0.0052 | 0.0039 | 6.4695 |
| 0.0063 | 0.0016 | 6.4695 |
| 0.0064 | −0.0009 | 6.4695 |
| 0.0057 | −0.0030 | 6.4695 |
| 0.0032 | −0.0079 | 6.4695 |
| 0.0007 | −0.0128 | 6.4695 |
| −0.0018 | −0.0176 | 6.4695 |
| −0.0043 | −0.0224 | 6.4695 |
| −0.0093 | −0.0321 | 6.4695 |
| −0.0144 | −0.0417 | 6.4695 |
| −0.0194 | −0.0513 | 6.4695 |
| −0.0245 | −0.0609 | 6.4695 |
| −0.0346 | −0.0801 | 6.4695 |
| −0.0501 | −0.1088 | 6.4695 |
| −0.0685 | −0.1422 | 6.4695 |
| −0.0873 | −0.1757 | 6.4695 |
| −0.1067 | −0.2094 | 6.4695 |
| −0.1268 | −0.2432 | 6.4695 |
| −0.1476 | −0.2773 | 6.4695 |
| −0.1695 | −0.3118 | 6.4695 |
| −0.1924 | −0.3465 | 6.4695 |
| −0.2167 | −0.3817 | 6.4695 |
| −0.2427 | −0.4172 | 6.4695 |
| −0.2705 | −0.4530 | 6.4695 |
| −0.3008 | −0.4891 | 6.4695 |
| −0.3341 | −0.5248 | 6.4695 |
| −0.3712 | −0.5588 | 6.4695 |
| −0.3913 | −0.5750 | 6.4695 |
| −0.4121 | −0.5902 | 6.4695 |
| −0.4342 | −0.6047 | 6.4695 |
| −0.4570 | −0.6181 | 6.4695 |
| −0.4810 | −0.6305 | 6.4695 |
| −0.5056 | −0.6416 | 6.4695 |
| −0.5312 | −0.6516 | 6.4695 |
| −0.5573 | −0.6601 | 6.4695 |
| −0.5844 | −0.6673 | 6.4695 |
| −0.6118 | −0.6730 | 6.4695 |
| −0.6398 | −0.6773 | 6.4695 |
| −0.6681 | −0.6801 | 6.4695 |
| −0.6968 | −0.6814 | 6.4695 |

TABLE I-continued

| X/CHX | Y/CHX | Z/CHX |
|---|---|---|
| −0.7256 | −0.6811 | 6.4695 |
| −0.7547 | −0.6792 | 6.4695 |
| −0.7836 | −0.6757 | 6.4695 |
| −0.8042 | −0.6721 | 6.4695 |
| −0.8247 | −0.6677 | 6.4695 |
| −0.8410 | −0.6634 | 6.4695 |
| −0.8571 | −0.6587 | 6.4695 |
| −0.8676 | −0.6552 | 6.4695 |
| −0.8779 | −0.6516 | 6.4695 |
| −0.8874 | −0.6479 | 6.4695 |
| −0.8968 | −0.6441 | 6.4695 |
| −0.9046 | −0.6408 | 6.4695 |
| −0.9123 | −0.6373 | 6.4695 |
| −0.9200 | −0.6337 | 6.4695 |
| −0.9276 | −0.6299 | 6.4695 |
| −0.9351 | −0.6260 | 6.4695 |
| −0.9426 | −0.6219 | 6.4695 |
| −0.9500 | −0.6177 | 6.4695 |
| −0.9571 | −0.6132 | 6.4695 |
| −0.9613 | −0.6102 | 6.4695 |
| −0.9652 | −0.6070 | 6.4695 |
| −0.9690 | −0.6036 | 6.4695 |
| −0.9726 | −0.6000 | 6.4695 |
| −0.9760 | −0.5963 | 6.4695 |
| −0.9791 | −0.5924 | 6.4695 |
| −0.9820 | −0.5883 | 6.4695 |
| −0.9846 | −0.5839 | 6.4695 |
| −0.9866 | −0.5800 | 6.4695 |
| −0.9885 | −0.5759 | 6.4695 |
| −0.9903 | −0.5709 | 6.4695 |
| −0.9917 | −0.5658 | 6.4695 |
| −0.9927 | −0.5612 | 6.4695 |
| −0.9933 | −0.5565 | 6.4695 |
| −0.9936 | −0.5527 | 6.4695 |
| −0.9936 | −0.5489 | 6.4695 |
| −0.9934 | −0.5489 | 6.6005 |
| −0.9932 | −0.5455 | 6.6005 |
| −0.9929 | −0.5421 | 6.6005 |
| −0.9922 | −0.5379 | 6.6005 |
| −0.9913 | −0.5338 | 6.6005 |
| −0.9900 | −0.5292 | 6.6005 |
| −0.9883 | −0.5247 | 6.6005 |
| −0.9869 | −0.5215 | 6.6005 |
| −0.9854 | −0.5184 | 6.6005 |
| −0.9841 | −0.5162 | 6.6005 |
| −0.9828 | −0.5140 | 6.6005 |
| −0.9808 | −0.5109 | 6.6005 |
| −0.9786 | −0.5079 | 6.6005 |
| −0.9761 | −0.5048 | 6.6005 |
| −0.9736 | −0.5019 | 6.6005 |
| −0.9709 | −0.4992 | 6.6005 |
| −0.9681 | −0.4965 | 6.6005 |
| −0.9631 | −0.4923 | 6.6005 |
| −0.9579 | −0.4884 | 6.6005 |
| −0.9523 | −0.4849 | 6.6005 |
| −0.9465 | −0.4817 | 6.6005 |
| −0.9406 | −0.4789 | 6.6005 |
| −0.9345 | −0.4764 | 6.6005 |
| −0.9284 | −0.4741 | 6.6005 |
| −0.9222 | −0.4720 | 6.6005 |
| −0.9147 | −0.4695 | 6.6005 |
| −0.9072 | −0.4670 | 6.6005 |
| −0.8991 | −0.4645 | 6.6005 |
| −0.8910 | −0.4620 | 6.6005 |
| −0.8784 | −0.4583 | 6.6005 |
| −0.8657 | −0.4549 | 6.6005 |
| −0.8499 | −0.4508 | 6.6005 |
| −0.8340 | −0.4469 | 6.6005 |
| −0.8118 | −0.4420 | 6.6005 |
| −0.7895 | −0.4374 | 6.6005 |
| −0.7672 | −0.4332 | 6.6005 |
| −0.7449 | −0.4292 | 6.6005 |
| −0.7227 | −0.4255 | 6.6005 |
| −0.7005 | −0.4218 | 6.6005 |
| −0.6784 | −0.4183 | 6.6005 |
| −0.6563 | −0.4147 | 6.6005 |
| −0.6344 | −0.4111 | 6.6005 |

TABLE I-continued

| X/CHX | Y/CHX | Z/CHX |
|---|---|---|
| −0.6126 | −0.4073 | 6.6005 |
| −0.5910 | −0.4034 | 6.6005 |
| −0.5694 | −0.3992 | 6.6005 |
| −0.5481 | −0.3948 | 6.6005 |
| −0.5270 | −0.3899 | 6.6005 |
| −0.5061 | −0.3848 | 6.6005 |
| −0.4854 | −0.3792 | 6.6005 |
| −0.4449 | −0.3667 | 6.6005 |
| −0.4057 | −0.3523 | 6.6005 |
| −0.3679 | −0.3360 | 6.6005 |
| −0.3317 | −0.3178 | 6.6005 |
| −0.2970 | −0.2979 | 6.6005 |
| −0.2640 | −0.2762 | 6.6005 |
| −0.2325 | −0.2531 | 6.6005 |
| −0.2026 | −0.2286 | 6.6005 |
| −0.1741 | −0.2029 | 6.6005 |
| −0.1471 | −0.1762 | 6.6005 |
| −0.1213 | −0.1487 | 6.6005 |
| −0.0967 | −0.1203 | 6.6005 |
| −0.0733 | −0.0913 | 6.6005 |
| −0.0540 | −0.0660 | 6.6005 |
| −0.0414 | −0.0488 | 6.6005 |
| −0.0353 | −0.0402 | 6.6005 |
| −0.0292 | −0.0315 | 6.6005 |
| −0.0232 | −0.0228 | 6.6005 |
| −0.0173 | −0.0140 | 6.6005 |
| −0.0143 | −0.0096 | 6.6005 |
| −0.0114 | −0.0052 | 6.6005 |
| −0.0085 | −0.0008 | 6.6005 |
| −0.0056 | 0.0036 | 6.6005 |
| −0.0040 | 0.0053 | 6.6005 |
| −0.0017 | 0.0064 | 6.6005 |
| 0.0009 | 0.0066 | 6.6005 |
| 0.0034 | 0.0057 | 6.6005 |
| 0.0053 | 0.0040 | 6.6005 |
| 0.0064 | 0.0016 | 6.6005 |
| 0.0066 | −0.0009 | 6.6005 |
| 0.0059 | −0.0031 | 6.6005 |
| 0.0033 | −0.0081 | 6.6005 |
| 0.0007 | −0.0130 | 6.6005 |
| −0.0018 | −0.0179 | 6.6005 |
| −0.0044 | −0.0228 | 6.6005 |
| −0.0096 | −0.0326 | 6.6005 |
| −0.0147 | −0.0424 | 6.6005 |
| −0.0199 | −0.0522 | 6.6005 |
| −0.0251 | −0.0620 | 6.6005 |
| −0.0355 | −0.0815 | 6.6005 |
| −0.0514 | −0.1107 | 6.6005 |
| −0.0702 | −0.1449 | 6.6005 |
| −0.0894 | −0.1790 | 6.6005 |
| −0.1092 | −0.2134 | 6.6005 |
| −0.1297 | −0.2479 | 6.6005 |
| −0.1509 | −0.2827 | 6.6005 |
| −0.1731 | −0.3177 | 6.6005 |
| −0.1963 | −0.3530 | 6.6005 |
| −0.2209 | −0.3887 | 6.6005 |
| −0.2471 | −0.4246 | 6.6005 |
| −0.2753 | −0.4606 | 6.6005 |
| −0.3058 | −0.4967 | 6.6005 |
| −0.3394 | −0.5321 | 6.6005 |
| −0.3767 | −0.5657 | 6.6005 |
| −0.3970 | −0.5815 | 6.6005 |
| −0.4179 | −0.5964 | 6.6005 |
| −0.4401 | −0.6104 | 6.6005 |
| −0.4630 | −0.6233 | 6.6005 |
| −0.4870 | −0.6352 | 6.6005 |
| −0.5116 | −0.6457 | 6.6005 |
| −0.5372 | −0.6551 | 6.6005 |
| −0.5632 | −0.6630 | 6.6005 |
| −0.5901 | −0.6696 | 6.6005 |
| −0.6173 | −0.6748 | 6.6005 |
| −0.6451 | −0.6786 | 6.6005 |
| −0.6731 | −0.6809 | 6.6005 |
| −0.7015 | −0.6817 | 6.6005 |
| −0.7299 | −0.6811 | 6.6005 |
| −0.7586 | −0.6789 | 6.6005 |
| −0.7871 | −0.6751 | 6.6005 |

TABLE I-continued

| X/CHX | Y/CHX | Z/CHX |
|---|---|---|
| −0.8074 | −0.6714 | 6.6005 |
| −0.8276 | −0.6669 | 6.6005 |
| −0.8436 | −0.6626 | 6.6005 |
| −0.8595 | −0.6578 | 6.6005 |
| −0.8698 | −0.6544 | 6.6005 |
| −0.8800 | −0.6507 | 6.6005 |
| −0.8893 | −0.6471 | 6.6005 |
| −0.8986 | −0.6433 | 6.6005 |
| −0.9062 | −0.6400 | 6.6005 |
| −0.9138 | −0.6365 | 6.6005 |
| −0.9214 | −0.6329 | 6.6005 |
| −0.9289 | −0.6292 | 6.6005 |
| −0.9363 | −0.6253 | 6.6005 |
| −0.9436 | −0.6213 | 6.6005 |
| −0.9508 | −0.6171 | 6.6005 |
| −0.9578 | −0.6126 | 6.6005 |
| −0.9619 | −0.6096 | 6.6005 |
| −0.9658 | −0.6064 | 6.6005 |
| −0.9695 | −0.6030 | 6.6005 |
| −0.9730 | −0.5995 | 6.6005 |
| −0.9762 | −0.5958 | 6.6005 |
| −0.9793 | −0.5919 | 6.6005 |
| −0.9821 | −0.5878 | 6.6005 |
| −0.9846 | −0.5835 | 6.6005 |
| −0.9866 | −0.5797 | 6.6005 |
| −0.9883 | −0.5757 | 6.6005 |
| −0.9902 | −0.5708 | 6.6005 |
| −0.9916 | −0.5657 | 6.6005 |
| −0.9925 | −0.5611 | 6.6005 |
| −0.9931 | −0.5564 | 6.6005 |
| −0.9934 | −0.5527 | 6.6005 |
| −0.9934 | −0.5489 | 6.6005 |

Furthermore, the aerodynamic profile of the blade according to the invention is obtained with the values of Table I by stacking together the series of closed curves 20 and connecting them so as to obtain a continuous aerodynamic profile.

To take into account the dimensional variability of each blade 1, preferably obtained by means of a melting process, the profile of each blade 1 can have a tolerance of +/−0.3 mm in a normal direction with respect the profile of the blade 1 itself.

The profile of each blade 1 can also comprise a coating, subsequently applied and such as to vary the profile itself.

Said anti-wear coating has preferably a thickness defined in a normal direction with respect to each surface of the blade and ranging from 0 to 0.5 mm.

Furthermore, it is evident that the values of the coordinates of Table I can be multiplied or divided by a corrective constant to obtain a profile in a greater or smaller scale, maintaining the same form.

According to the present invention, a considerable increase in the flow function has been obtained, which is directly associated with the flow-rate, with respect to turbines having the same dimensional characteristics.

More specifically, using a stator according to the present invention, the flow function was considerably increased with respect to turbines with the same dimensions, at the same time maintaining a high conversion efficiency.

At the same time, each blade therefore has an aerodynamic profile which allows a high conversion efficiency and a high useful life to be maintained.

The invention claimed is:

1. A stator for the first phase of a low-pressure turbine having a series of blades each defined by coordinates of a discreet combination of points, in a Cartesian reference system (X,Y,Z), wherein the axis (Z) is a radial axis intersecting the central axis of the turbine, the profile of each blade being identified by means of a series of closed intersection curves between the profile itself and planes (X,Y) lying at distances (Z) from the central axis, each blade having an average throat angle defined by the cosine arc of the ratio between the average throat length at mid-height of the blade and the circumferential pitch evaluated at the radius of the average throat point, wherein said average throat angle ranges from 57° to 60°, and further wherein said closed curves are defined according to Table I, whose values refer to a room temperature profile and are divided by the value, expressed in millimeters, of the axial chord referring to the most external distance (Z) of the blade (1).

2. The stator according to claim 1, wherein said average throat angle is 58.5°.

3. The stator according to claim 1, wherein each of said closed curves has a throat angle defined by the cosine arc of the ratio between the throat length and the circumferential pitch, evaluated at the radius corresponding to the distance (Z) from the central axis of the closed curve itself, and characterized in that each blade has a distribution of throat angles along the height (Z) of the blade, said distribution with respect to said average throat angle having a shift ranging from +1° to −1°.

4. The stator according to claim 1, wherein the profile of each blade has a tolerance of +/−0.3 mm in a normal direction with respect to the profile of the blade itself.

5. The stator according to claim 1, wherein the profile of each blade includes an anti-wear coating.

6. The stator for the first phase of a low-pressure turbine according to claim 5, wherein said coating has a thickness ranging from 0 to 0.5 mm.

* * * * *